US006157031A

United States Patent [19]

Prestage

[11] Patent Number: 6,157,031

[45] Date of Patent: Dec. 5, 2000

[54] QUADROPOLE MASS ANALYZER WITH LINEAR ION TRAP

[75] Inventor: John D. Prestage, Pasadena, Calif.

[73] Assignee: California Institute of Technology, Pasadena, Calif.

[21] Appl. No.: 09/156,099

[22] Filed: Sep. 17, 1998

Related U.S. Application Data

[60] Provisional application No. 60/059,162, Sep. 17, 1997.

[51] Int. Cl.[7] ..... H01J 49/42

[52] U.S. Cl. ..... 250/292; 250/290

[58] Field of Search ..... 250/292, 293, 250/281, 282, 290; 313/256

[56] References Cited

U.S. PATENT DOCUMENTS 3,648,046 3/1972 Denison et al. ..... 250/292

4,985,626 1/1991 Margulies ..... 250/292

5,401,962 3/1995 Ferran ..... 250/292

*Primary Examiner*—Kiet T. Nguyen

*Attorney, Agent, or Firm*—Fish & Richardson P.C.

[57] ABSTRACT

The present invention describes a quadrupole mass analyzer with linear ion trap. The quadrupole mass analyzer functions in a dual-mode. A conventional transmission mode operates with external ionizer supplying ions to the quadrupole analyzer. In an ion trap mode, DC endcap electrodes are attached to the rf quadrupole cylinder to form a trapping chamber where ions are confined. The preferred mode is based on a segmented cylinder electrode geometry which produces a substantially quadrupolar field distribution as used in a conventional four-rod quadrupole mass analyzer. Electrodes are generated from a cylinder that has been segmented along its length into some number of electrically isolated electrodes.

22 Claims, 7 Drawing Sheets

QUADROPOLE MASS ANALYZER WITH LINEAR ION TRAP

CROSS-REFERENCE TO RELATED APPLICATIONS

This application claims benefit of the priority of U.S. Provisional application Ser. No.60/059,162, filed Sep. 17, 1997 and entitled "Linear Ion Trap based Quadrupole Mass Analyzer and Quadrupole Mass Analyzer based on a Segmented Cylinder."

ORIGIN OF INVENTION

The invention described herein was made in performance of work under a NASA contract, and is subject to the provisions of Public Law 96-517 (35 U.S.C. 202) in which the Contractor has elected to retain title.

TECHNICAL FIELD

The invention relates to an improved quadrupole mass analyzer with linear node ion trap for trapping and separating charged particles by utilizing electric fields according to their charge-to-mass ratio.

BACKGROUND

A quadrupole mass analyzer separates ions with different masses by applying a DC voltage and an rf voltage on four rods having hyperbolic cross sections and an axis equidistant from each rod. Combined DC and rf voltages on the quadrupole rods are set to pass only ions which have a selected mass-to-charge ratio (m/e). All other ions, i.e., those which do not have that selected charge to mass ratio, do not have a stable trajectory through the quadrupole mass analyzer. These other ions will collide with the quadrupole rods, never reaching the detector. The electrode structure 100 required to generate the quadrupole field has hyperbolic cylinders forming electrodes 102–108 with semiaxes both equal to a distance $r_o$, the so-called field radius. This basic structure is shown in FIG. 1.

A conventional four-rod quadrupole mass analyzer geometry 200 is shown in FIG. 2A. Each of the four rods 202–208 is constrained to a rod radius of approximately $1.147r_o$. The whole assembly is typically housed inside a grounded cylinder 210 at radius of approximately $3.54r_o$. These values are chosen to make large distorting terms in a quadrupolar electric potential cancel out. The quadrupole mass analyzer may alternately be constructed of 16 rod electrodes in a 4×4 array 201 to form nine separate quadrupolar regions 212 as shown in FIG. 2B. This instrument, however, is quite bulky and must be carefully constructed to produce substantially quadrupolar fields. Additionally, the outer cylinder 214 must be constructed so as to shield the inner fields from outside conductors.

The quadrupole mass analyzer has long been one of the most sensitive and transportable instruments for determining the composition of an unknown sample e.g. a gas sample. It has become one of several standard laboratory and commercial instruments for use in chemical analysis, environmental monitoring, and as a residual gas analyzer. The quadrupole mass analyzer is a commonly flown instrument for planetary aeronomy studies. Other uses include planetary surface studies and geological aging.

The quadrupole mass analyzer has probed the earth's atmosphere from aircraft, balloons, and sounding rockets. It has been carried across the solar system as an instrument on the Galileo spacecraft, released into the Jovian atmosphere and has precisely measured the constituents of the atmosphere of this giant planet. The Cassini spacecraft will carry a similar mass analyzer to be dropped into Saturn's upper atmosphere. The long and widespread use of this technology has proven it to be one of the most useful analytical instruments ever developed.

However, in order to fulfill National Aeronautical Space Agency's (NASA) mandate of having "faster, better, cheaper" space missions, smaller instruments are desired in order to reduce mass, volume, and power so that planetary missions are carried out at much less cost and, hence, with a higher frequency.

More recently, ion trap quadrupole mass analyzers have been used to analyze gas samples. In an ion trap analyzer, ions are dynamically stored in a three-dimensional quadrupole ion storage device. The rf and DC potentials are scanned to eject successive mass-to-charge (m/e) ratios from the trap into a detector. In addition, very large masses are stored by reducing the frequency, f of the trapping field since the maximum mass selected is $M_{max}=7\times10^6=V_{max}/(f^2r_o^2)$ where $V_{max}$ is the operating voltage. This typically cannot be achieved in a "single pass" quadrupole mass analyzer mode, especially for a small instrument, since the condition of frequency being much greater than the inverse of ion transit time through quadrupole mass analyzer is necessary for adequate mass resolution.

In a conventional point node trap, electrons enter the trap from outside and must transit through the region of high trap field except during the short time when the phase of the rf is near a zero of the field cycle. The usable portion of the trap, a small volume $4\pi r_o^3/3$ centered on the node, where the ion creation must occur, is smaller than the similar volume, $\pi r_o^2 L$, within a distance $r_o$ of the node line in linear trap of length L. This is so because L is significantly larger than $r_o$.

SUMMARY

The present disclosure describes a quadrupole mass analyzer with linear ion trap. The quadrupole mass analyzer functions in a dual-mode. A conventional transmission mode operates with external ionizer supplying ions to the quadrupole analyzer. In an ion trap mode, DC endcap electrodes are attached to the rf quadrupole cylinder to form a trapping chamber where ions are confined. The preferred mode is based on a segmented cylinder electrode geometry which produces a substantially quadrupolar field distribution as used in a conventional four-rod quadrupole mass analyzer but requires only approximately 10% of the mass and volume.

In the preferred embodiment, sub-electrodes are generated from a cylinder 300. The cylinder 300 is segmented along its length into some number of electrically isolated electrodes as shown in FIG. 3A and 3B. A relatively thin-walled cylinder is used. For quadrupole mass analyzers of the same length, an N times reduction in cross-sectional area should yield approximately N times reduction in mass. The smaller cylindrical structure also requires less energy stored in the electric field and, therefore, the less power is consumed than a conventional quadrupole mass analyzer.

In preferred embodiments, the sub-electrodes 302–316 are formed from an 8-segment cylinder. In further embodiments, the sub-electrodes are formed from a 16-segment cylinder. In another alternative embodiment, the sub-electrodes are formed from a 4-segment cylinder.

Another embodiment adds an endcap electrode on each end of the quadrupole mass analyzer to form a trapping chamber. In one embodiment, the quadrupole mass analyzer is the conventional four-rod quadrupole analyzer. In another embodiment, the quadrupole mass analyzer is the segmented cylinder analyzer. An ion trap mass spectrometer that will store ions of a single mass-to-charge ratio (m/e) is created when an endcap electrode is added to each end of the quadrupole mass analyzer. In preferred embodiments, the ions are trapped in a trapping chamber with a linear node of an rf trapping field.

An important advantage of the cylindrical geometry is in the fabrication of a micro-array quadrupole mass analyzer shown in FIG. 5A. This cylindrical geometry is fabricated from a planar substrate including insulating 500 and conducting 502 layers. The desired cylindrical quadrupole mass analyzer of radius $r_o$ is generated from conducting 502 layers separated by thin insulating 500 layers. Such layered structures are readily fabricated on a micro-device scale. If adjacent conducting layers alternate in thickness between $r_o$ and $0.366r_o$, micro-machining a circular hole 504 of radius $r_o$ in the center of the conducting layer of thickness $r_o$ will yield an open cylinder whose walls are sectored into 30° and 60° sections. An array of cylindrical quadrupole mass analyzers is fabricated from a layered conductor/insulator substrate by micro-machining plurality of holes as described above.

The present disclosure also includes a method of fabricating the segmented cylinder quadrupole mass analyzer with the linear ion trap according to the procedures described above.

BRIEF DESCRIPTION OF THE DRAWINGS

Like reference numbers and designations in the various drawings indicate like elements.

DETAILED DESCRIPTION

Figure 1:
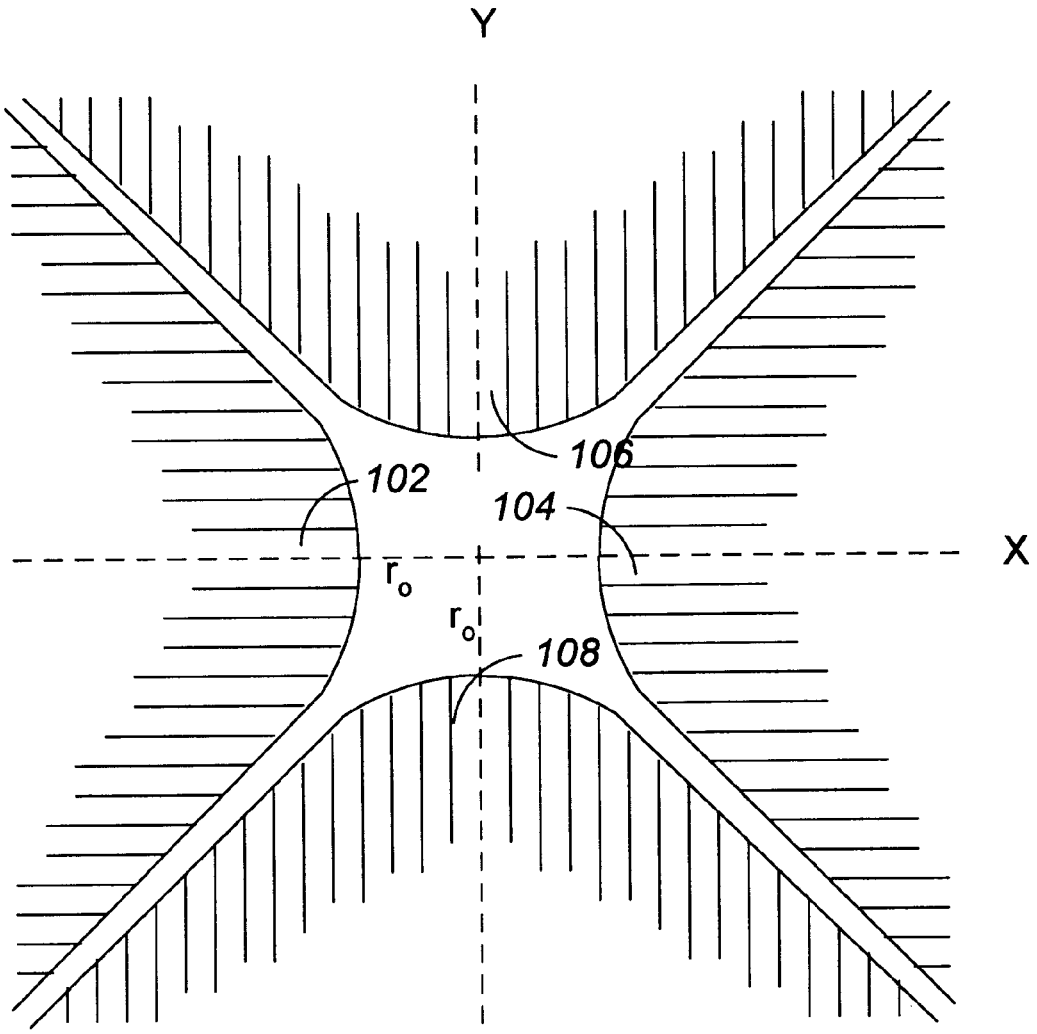
FIG. 1 (PRIOR ART)
FIG. 1 is a cross-sectional illustration of a prior art quadrupole mass analyzer.
Figure 2A:
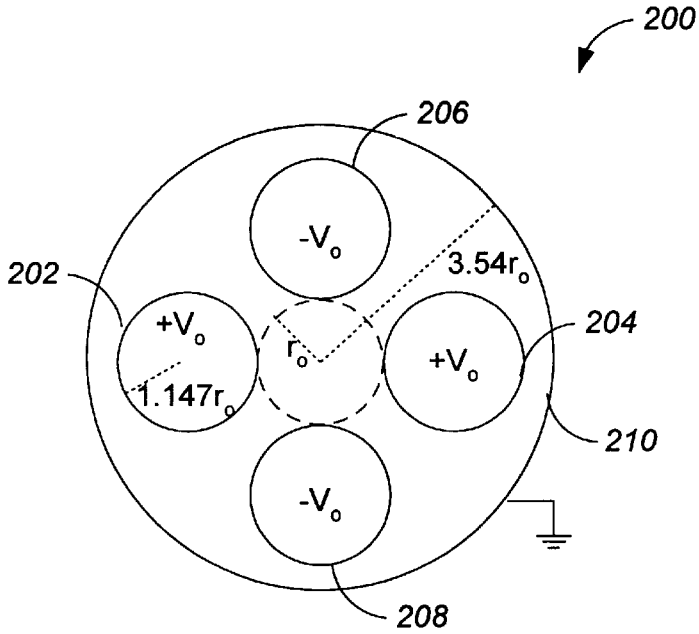
FIG. 2A (PRIOR ART)
FIG. 2A is a top view of a prior art four-rod quadrupole mass analyzer geometry.
Figure 2B:
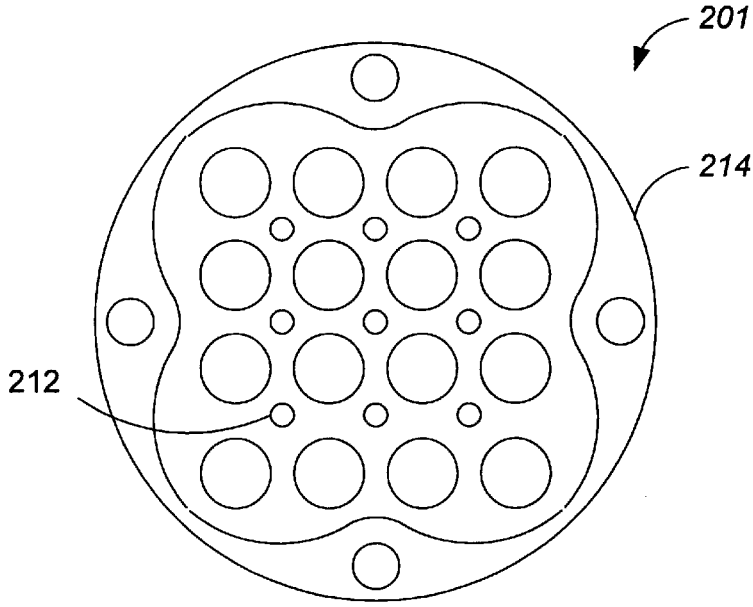
FIG. 2B (PRIOR ART)
FIG. 2B is a top view of a prior art quadrupole mass analyzer geometry constructed in a 4×4 array to form nine separate quadrupolar regions.
Figure 3A:
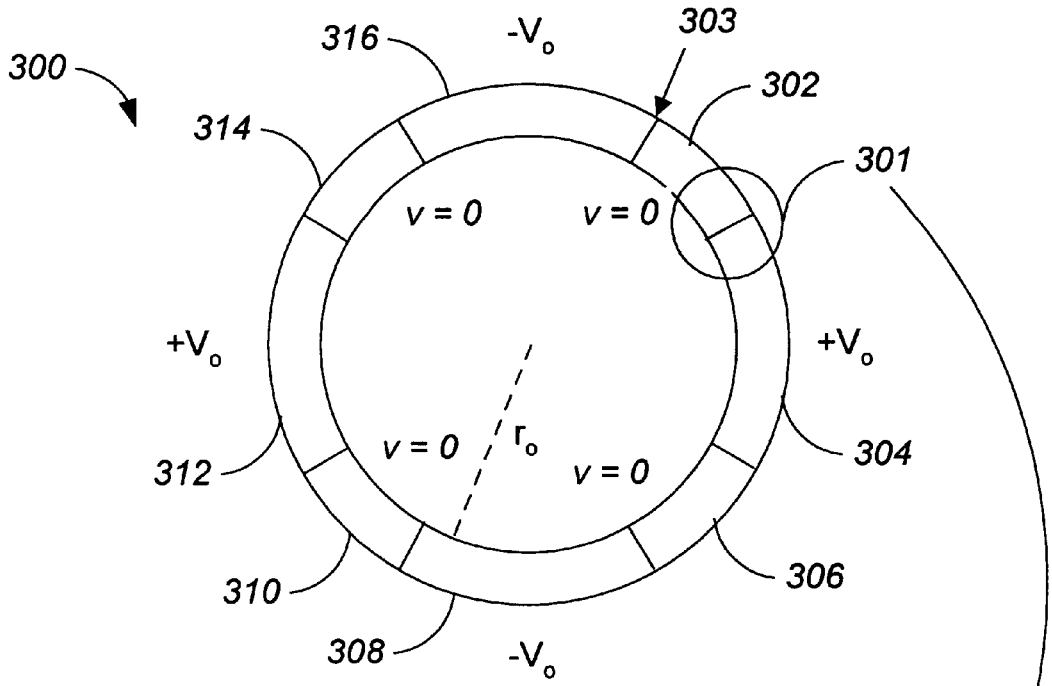
FIG. 3A is a top view of a segmented cylinder quadrupole mass analyzer with electrode geometry shown.

FIG. 3A shows a first embodiment of a "Segmented Cylinder" quadrupole mass analyzer 300. The analyzer is based on an electrode geometry which produces a quadrupolar field distribution as used in a conventional four-rod quadrupole mass analyzer. Appropriate reduction of the size of the cylinder produces a quadrupole mass analyzer that requires only approximately 10% of the mass and volume of the conventional four-rod quadrupole mass analyzer that is described with reference to FIG. 2A.

The segmented cylinder quadrupole mass analyzer sub-electrodes 302–316 are formed from a single cylinder 300 that has been segmented along its length into some number of electrically isolated electrodes. The sub-electrodes 302–316 are isolated by thin insulating layers 303. The cylinder can be sectored into eight, sixteen or four sub-electrode sections. In preferred embodiments, the cylinder is sectored into eight sub-electrode sections with angular widths 30° and 60°. The four grounded 30° sub-electrodes 302, 306, 310, and 314 suppress a large distorting term in the field expansion as did the choice of rod radius $1.147r_o$ in the conventional four-rod quadrupole mass analyzer 200. That is, the large distorting term$C_1(r/r_o)^6 \cos(6\phi)$ vanishes to make a quadrupolar electric potential, $\Phi$, differ from the ideal $\Phi(r,\phi)=C_o(r/r_o)^2 \cos(2\phi)$ by only a small term $C_2(r/r_o)^{10} \cos(10\phi)$.

A two dimensional expression for a potential, $\Phi(\rho,\phi)$, inside a cylinder of radius $r_o$ is shown as follows:

$$\Phi(\rho,\varphi)=\frac{1}{2\pi}\int_0^{2\pi}\frac{V(\varphi')(1-\rho^2)d\varphi'}{(1+\rho^2-2\rho\cos(\varphi'-\varphi))}=\frac{1}{2\pi}\int_0^{2\pi}V(\varphi')d\varphi'\left[1+2\sum_{n=1}^{\infty}\rho^n\cos(n(\varphi'-\varphi))\right]$$

where $\rho=r/r_o$ is the normalized radial distance coordinate from cylinder center, $\phi$ is the angular coordinate, and $V(\phi')$ is the potential around the inside wall of the cylinder. The potential for a generic quadrupole geometry is determined by the condition $V(\phi)=-V(\phi\pm\pi/2)$ and leads to:

$$\Phi(\rho,\varphi)=\frac{8}{\pi}\sum_{n=0}^{\infty}\rho^{2(2n+1)}\sin(2(2n+1)\varphi)\int_0^{\frac{\pi}{4}}d\varphi' V(\varphi')\sin(2(2n+1)\varphi')$$

where we have assumed symmetry around the $\phi'=\pi/4$ line, $V(\phi')=V(\pi/2-\phi')$ is assumed. Note that $V(\phi')=V_o \sin(2\phi)$ generates the pure quadrupolar field, $V_o(r/r_o)^2 \sin(2\phi)$, inside the cylinder, identical to that supplied by four hyperbolic electrodes whose innermost points touch the radius $r_o$ at $\phi=\pm\pi/4$, $\pm\pi/4$.

A series expansion $\Phi(\rho,\phi)=C_o(r/r_o)^2 \sin(2\phi)+C_1(r/r_o)^6 \sin(6\phi)+C_2(r/r_o)^{10} \sin(10\phi)+\ldots$ shows departure from the pure quadrupole $C_o$ term for a specified electrode configuration. To produce a pure quadrupole field, hyperbolic electrodes must extend to infinity, and must be accurately machined and aligned so that no real world device will suppress all but the $C_o$ term. The $C_1$ term leads to the largest distortion over most of the interior of the quadrupole mass analyzer and may be all that is worthwhile eliminating in a practical device.

Figure 3B:
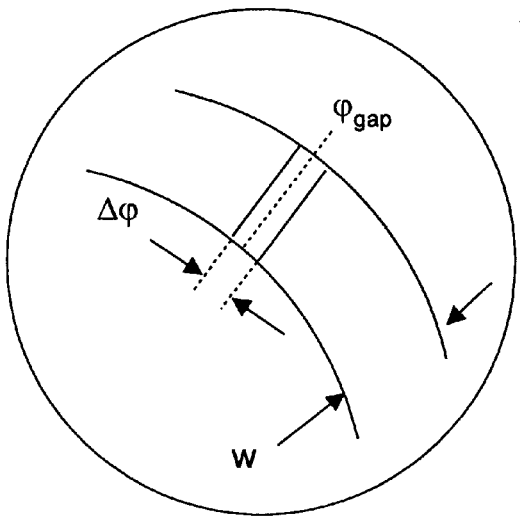
FIG. 3B is an expanded view of a portion of the segmented cylinder quadrupole mass analyzer.
Figure 4:
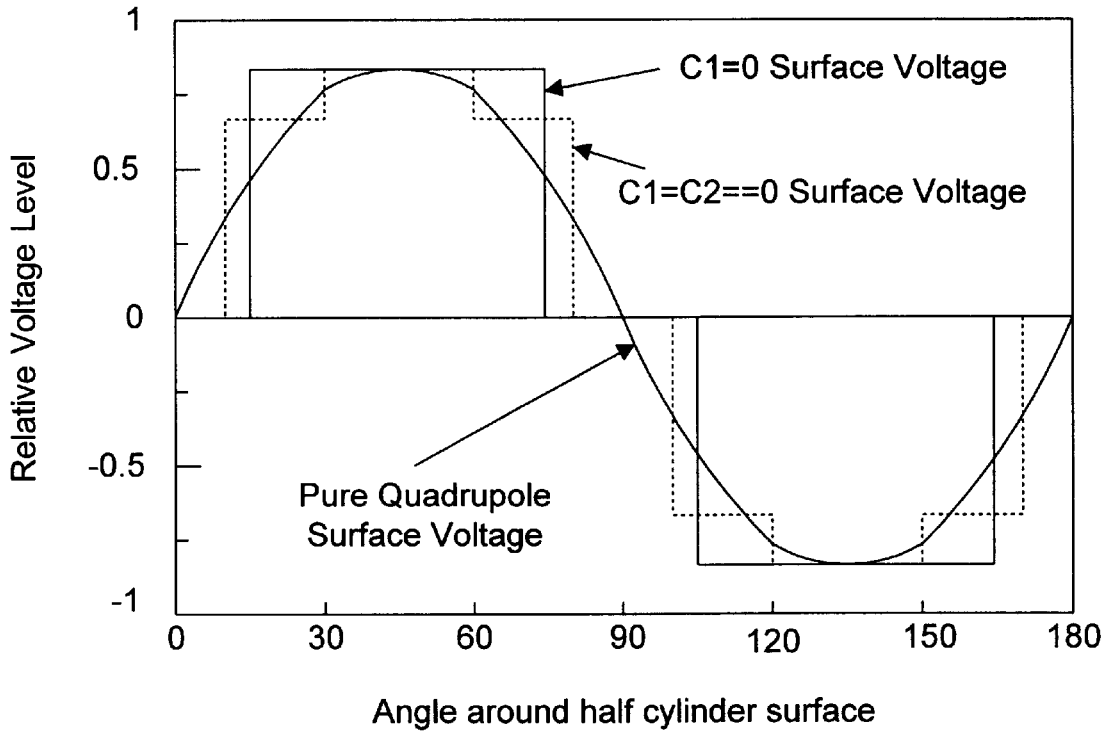
FIG. 4 is a surface voltage pattern for the production of a quadrupolar field distribution inside the segmented cylinder.

While it may not be practical to generate the exact $V_o \sin(2\phi')$ potential distribution, a simple approximation to this distribution exists which suppress the $C_1$ distortion. The cylinder wall is partitioned into eight sections of angular widths 30° and 60° with 30° sectors grounded and the 60° sectors biased to $\pm V_o$. The coefficients in the power series expansion for this electrode configuration are:

$$C_n = \frac{8}{\pi}\int_0^{\frac{\pi}{4}} d\varphi' V(\varphi')\sin(2(n+1)\varphi') = \frac{8V_0}{\pi}\int_{\frac{\pi}{12}}^{\frac{\pi}{4}} d\varphi' \sin(2(2n+1)\varphi') = \frac{4V_0\cos(2n+1)\frac{\pi}{6}}{(2n+1)\pi}$$

showing that $C_1=0$. A next closer approximation to the $V_o \sin(2\phi')$ ideal, where both $C_1$ and $C_2$ vanish is shown in FIG. 4. This configuration requires two voltage levels, $\pm V_o$ and $\pm V_o/\sqrt{2}$ with the cylinder wall partitioned into 16 equal sections of angular width $\pi/8$. A real quadrupole mass analyzer cylinder will have a non-zero spacing at the boundary between the sectors and the potential inside will be somewhat different from the above expressions. For the eight sector cylinder, small gap 301 between the sub-electrodes is modeled by a potential change from 0 to $V_o$ linear in $\phi'$ across the gap and we find the corrected values for $C_n$:

$$C_n = \frac{4V_0\cos 2(2n+1)\varphi_{gap}}{(2n+1)\pi}\frac{\sin(2n+1)\Delta\varphi}{(2n+1)\Delta\varphi}$$

where $\phi_{gap}$ is the center of the opening between sub-electrodes and $\Delta\phi$ (normally much less than 1) is the gap width (see FIG. 3B). Note that the opening between sub-electrodes does not change the angular sector position since $C_1=0$ at $\phi_{gap}=15°$. This correction factor is only important for $(2n+1)\Delta\phi$ greater than or equal to 1, that is, out near the cylinder wall.

A finite element computation of the fields was done in both the cylindrical and conventional circular rod geometry to compare the capacitances of the two electrode configurations. In the cylindrical case, the capacitance varies with cylinder wall thickness, w, and gap size, $\Delta\phi$. With $\Delta\phi=0.09$ radians and $w/r_o=0.055$, the electrode capacitance and, hence, energy stored in the rf electric field is found to be two times smaller in the cylinder based quadrupole mass analyzer than in the conventional four-rod geometry. The four-rod structure stores field energy in the relatively large regions between the rods (of opposite polarity) and between the rods and the outer grounded cylinder. Although the eight sector cylinder has larger peak fields across the gaps between the sectors, the spatial extent of these field regions is much smaller so that total field energy stored is four times less in the cylindrical geometry. Since the $C_o$ term for the eight sector cylinder is $(2\sqrt{3}\times/\pi)V_o$, that is approximately 1.1 times the pure quadrupole value, $V_o$, it will require approximately 10% less voltage to operate. With the slightly lower operating voltage $V_o$ and one-half of the capacitance, the cylindrical quadrupole mass analyzer will then dissipate only about 40% of the power of the four-rod quadrupole mass analyzer.

Figure 5A:
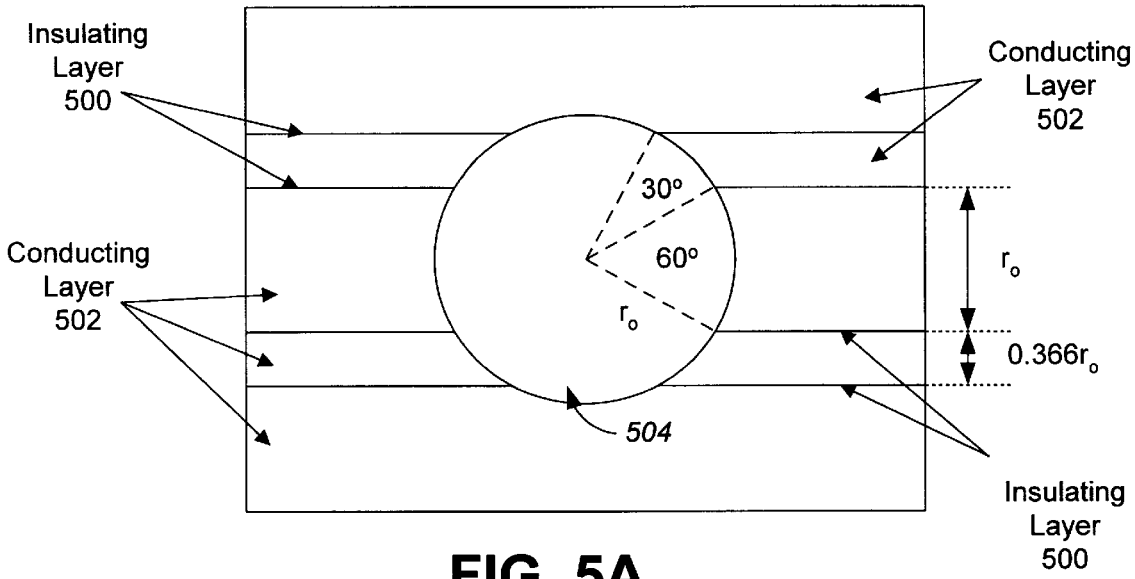
FIG. 5A is an illustration of the fabrication of an eight-segment ion trap quadrupole mass analyzer showing a cylindrical hole drilled into a layered substrate of insulators and conductors.
Figure 5B:
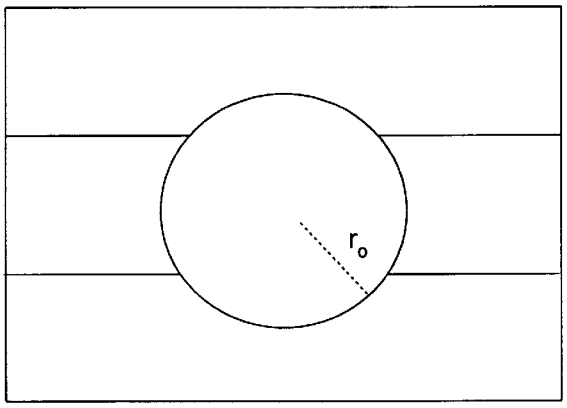
FIG. 5B is an illustration of the fabrication of a 4-segment ion trap quadrupole mass analyzer showing a cylindrical hole drilled into a layered substrate of insulators and conductors.
Figure 5C:
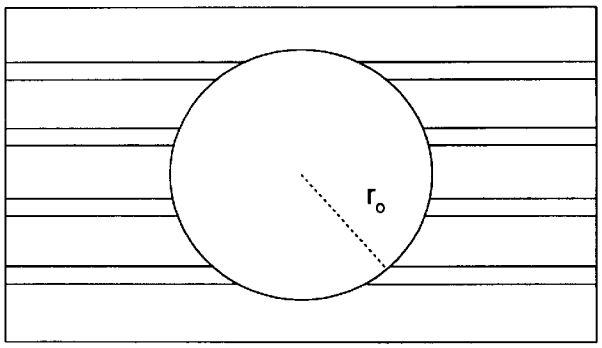
FIG. 5C is an illustration of the fabrication of a 16-segment ion trap quadrupole mass analyzer showing a cylindrical hole drilled into a layered substrate of insulators and conductors.

An important advantage of the cylindrical geometry is in the fabrication of a micro-array analyzer shown in FIG. 5A. This cylindrical geometry is fabricated from a planar substrate of insulating 500 and conducting 502 layers. The desired cylindrical quadrupole mass analyzer of radius $r_o$ is generated from conducting 502 layers separated by thin insulating 500 layers. Such layered structures are readily fabricated on a micro-device scale. If adjacent conducting layers alternate in thickness between $r_o$ and $0.366r_o$, micro-machining a circular hole 504 of radius $r_o$ in the center of the conducting layer of thickness $r_o$ will yield an open cylinder whose walls are sectored into 30° and 60° sections.

Figure 6:
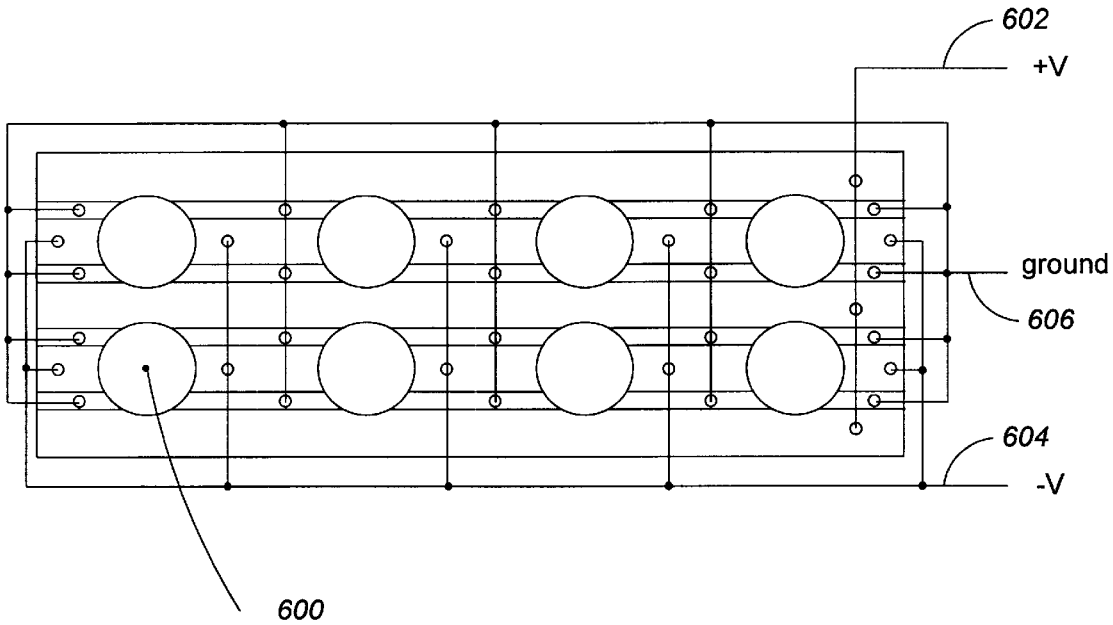
FIG. 6 is an array of eight micro-quadrupole mass analyzers fabricated from the layered substrate of insulators and conductors.

FIG. 6 shows an array of eight micro-quadrupole mass analyzers. The array of cylindrical quadrupole mass analyzers is fabricated from a layered conductor/insulator substrate by micro-machining several holes as described above. The axis 600 of each quadrupole mass analyzer is centered on and parallel to the thick layer conductor. To generate the mass selective rf fields inside the array of open cylinders, the thick conducting layers are alternately biased +V 602and −V 604. The eight quadrupole mass analyzers use five thick conducting layers, three biased at +V 602 and two biased at −V 604. The four thin conducting layers are grounded 606. The bias requirement is easily satisfied with the wiring shown. This array can be quite naturally enlarged to a 10 by 10 matrix of 100 quadrupole mass analyzers or even more.

There are other advantages to this cylinder based geometry. Because the sub-electrodes are constructed from a single parent cylinder, the stringent uniformity of the radius $r_o$ along the length of the mass filter required for mass resolution can be achieved in a real device. Additionally, since the structure is closed, no carefully-made outer cylinder is required to shield the inner fields from outside conductors as for the conventional four-rod geometry. Also, the reduced capacitance of the cylinder based sub-electrodes means a reduction in mass of the rf power supply to drive the quadrupole mass analyzer since the rf currents drawn from the supply are only 40% of the conventional quadrupole mass analyzer.

Figure 7:
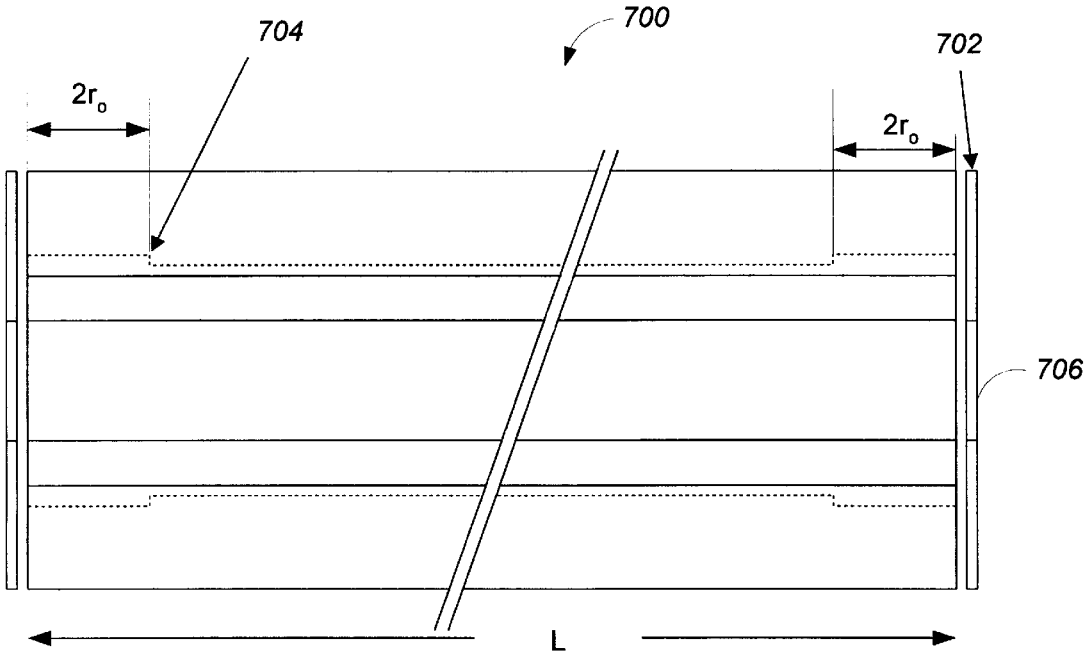
FIG. 7 is a cross-sectional view of a linear ion trap quadrupole mass analyzer.

A linear ion trap mass spectrometer 700 that will store ions of a single m/e is created when an endcap electrode 702 is added to each end of the quadrupole mass analyzer as shown in FIG. 7. In linear ion trap 700, the ions are trapped around a linear node of the rf trapping field with DC end fields to prevent ions from escaping out the ends. Each endcap electrode has an opening 706 approximately $r_o$ in radius on the centerline of axis to allow ions to be extracted from the trap. Ions readily move along the axis of a long linear trap of length L by an application of a simple DC bias. Additionally, since the ionizing electron beam is centered on and is parallel to the node line of the rf electric field many more ions can be generated with usable trajectories. The geometry of the linear trap thus has approximately $L/r_o$ times the usable volume for ion creation as compared to the point node trap. Since L is several times larger than $r_o$, the usable volume for ion creation is correspondingly larger in linear trap.

Figure 8:
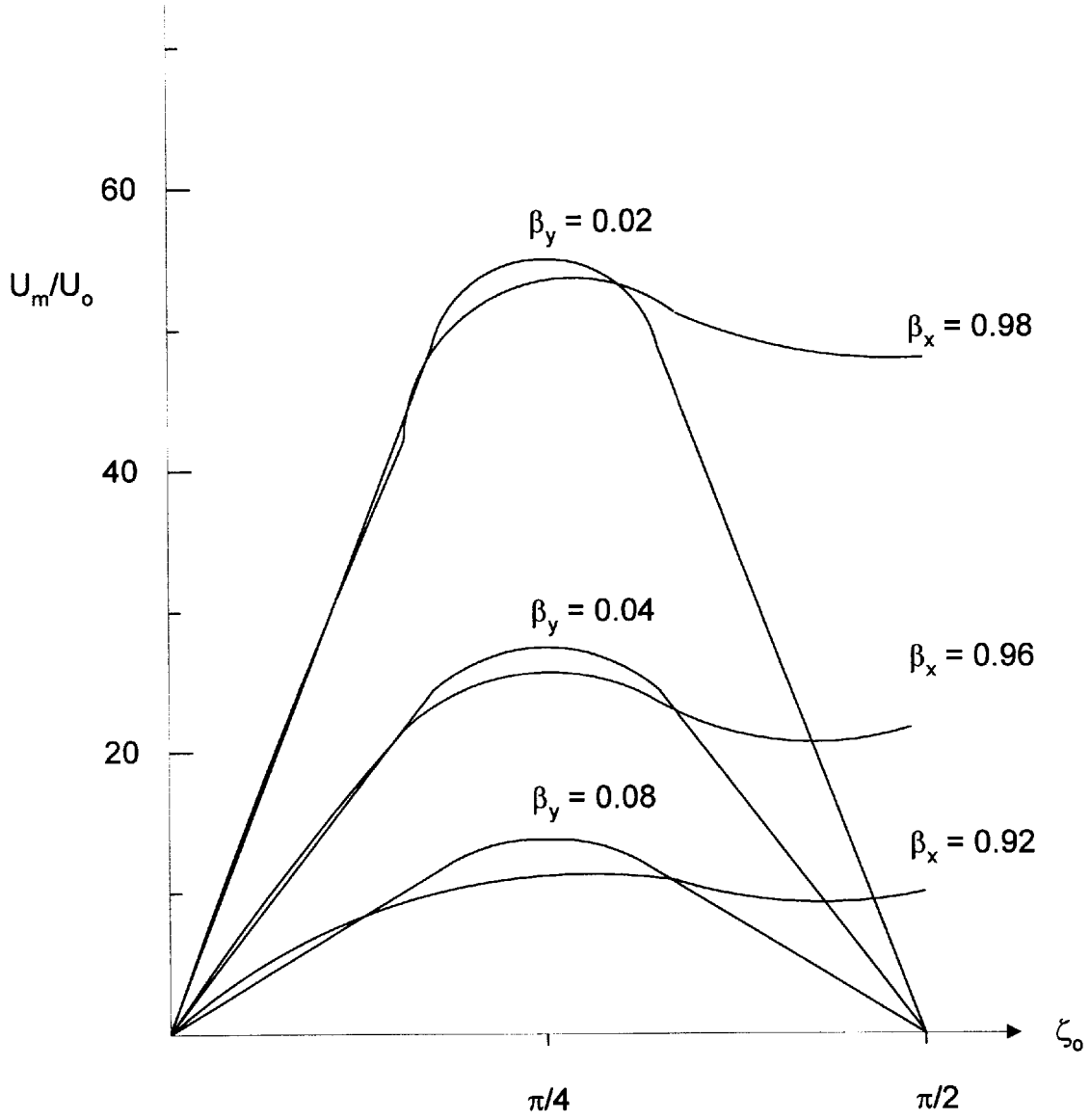
FIG. 8 is a graph of the ratio of maximum ion oscillation amplitude ($u_m$) to initial ion displacement ($u_o$) vs. phase of trap field rf for three mass resolution operating conditions in an ion trap quadrupole mass analyzer.

In a mass selective mode of linear ion trap, the single m/e value selected is near its stability limit and undergoes large amplitude motion depending on the phase of the rf and distance from the node line axis at the instant of its creation. Only ions created within a certain distance, $D=r_o/(u_m/u_o)$ of the node remain in the trap without hitting a wall. This is illustrated in FIG. 8 where the ratio of maximum ion amplitude to initial ion amplitude $(u_m/u_o)$ vs. phase of the trapping field $(\zeta_o)$ is shown for three operating points near the tip of the stability diagram. These three operating points correspond to mass resolution of 280, 70 and 18. In FIG. 8, the three operating points are expressed in terms of $\beta_x$. and $\beta_y$ where mass resolution, $$R = \frac{1}{2.23}\left(\frac{1}{2\beta_y}\right)^2.$$

The term $\beta_y$ is related to the number of cycles the ions spend in the field. Thus, at mass resolution 280 (=$\beta_y$0.02), at the $\pi/4$ phase point, only ions created within approximately $r_o/55$ of the field node will avoid hitting the electrode at radius $r_o$ and be analyzed by the ion trap mass analyzer. Therefore, D, which is inversely proportional to the ratio $u_m/u_o$, diminishes with increasing mass resolution.

A number of embodiments of the present invention have been described. Nevertheless, it will be understood that various modifications may be made without departing from the spirit and scope of the invention. For example, while the invention has been described in terms of an eight-segment cylinder, the invention may be implemented as any number of segments, preferably four or more segments. Accordingly, other embodiments are within the scope of the following claims.

What is claimed is:

1. A quadrupole mass analyzer for analyzing samples comprising:

a single-cylinder electrode for a quadrupole mass analyzer, said electrode formed from a cylindrical member which is segmented along its length into a plurality of sub-electrodes with plurality of insulating elements between sub-electrodes, each of which defines a section of a cylinder, where said electrode is configured to substantially eliminate terms that represent distortions from a pure quadrupolar rf electric field distribution; and a bias element, biasing the electrode for the quadrupole mass analyzer to produce a substantially pure quadrupolar rf electric field distribution.

2. The quadrupole mass analyzer of claim 1, wherein the electrode for the quadrupole mass analyzer is segmented into four sections.

3. The quadrupole mass analyzer of claim 1, wherein the electrode for the quadrupole mass analyzer is segmented into eight sections to substantially eliminate a first distortion term ($C_1$) from the quadrupolar rf electric field equation.

4. The quadrupole mass analyzer of claim 1, wherein the electrode for the quadrupole mass analyzer is segmented into sixteen sections to substantially eliminate both first and second distortion terms ($C_1$ and $C_2$) from the quadrupolar rf electric field equation.

5. The quadrupole mass analyzer of claim 1, further comprising:

two endcap electrodes, one attached at each end of the segmented cylinder to form an ion trap, wherein the two end cap electrodes and the segmented cylinder form a trapping chamber.

6. The ion trap quadrupole mass analyzer of claim 5, wherein the substantially quadrupolar rf electric field forms a linear node of an rf trapping field with DC end fields to trap the ions within the trapping chamber.

7. Analyzer as in claim 1, wherein said bias element comprises:

means for grounding the alternating sub-electrodes;

means for applying a positive rf voltage to the alternating non-grounded sub-electrodes; and means for applying a negative rf voltage to the rest of the sub-electrodes.

8. A quadrupole mass analyzer for analyzing samples comprising:

an electrode for a quadrupole mass analyzer, said electrode fabricated from a planar substrate of alternating insulating and conducting layers, wherein the conducting layers alternate in thickness between approximately $r_o$ and $0.366r_o$ and the conducting layer of thickness $r_o$ has a circular hole of radius approximately $r_o$ in the center;

means for grounding the conducting layers of thickness $0.366r_o$; and means for alternately applying positive and negative rf voltages to the conducting layers of thickness $r_o$, wherein the electrode for the quadrupole mass analyzer produces a substantially quadrupolar rf electric field distribution.

9. The quadrupole mass analyzer of claim 8, wherein the layers are fabricated on a micro-device scale.

10. An ion trap quadrupole mass analyzer for analyzing samples comprising:

a single-cylinder electrode for an ion trap quadrupole mass analyzer, said electrode formed from a cylindrical member which is segmented along its length into a plurality of sub-electrodes with plurality of insulating elements between sub-electrodes, each of which defines a section of a cylinder, where said electrode substantially eliminates terms that represent distortions from a pure quadrupolar rf electric field distribution;

two endcap electrodes, one attached at each end of the segmented cylinder to form an ion trap, wherein the two end cap electrodes and the segmented cylinder form a trapping chamber;

a bias element, biasing the electrode for the ion trap quadrupole mass analyzer to produce a substantially pure quadrupolar rf electric field distribution.

11. The ion trap quadrupole mass analyzer of claim 10, wherein the electrode for the ion trap quadrupole mass analyzer is segmented into four sections.

12. The ion trap quadrupole mass analyzer of claim 10, wherein the electrode for the ion trap quadrupole mass analyzer is segmented into eight sections.

13. The ion trap quadrupole mass analyzer of claim 10, wherein the electrode for the ion trap quadrupole mass analyzer is segmented into sixteen sections.

14. The ion trap quadrupole mass analyzer of claim 10, wherein the substantially quadrupolar rf electric field is a linear node of an rf trapping field with DC end fields to trap the ions within the trapping chamber.

15. Analyzer as in claim 10, wherein said bias element comprises:

means for grounding the alternating sub-electrodes;

means for applying a positive rf voltage to the alternating non-grounded sub-electrodes; and means for applying a negative rf voltage to the rest of the sub-electrodes.

16. An ion trap quadrupole mass analyzer for analyzing samples comprising:

an electrode for a quadrupole mass analyzer, said electrode fabricated from a planar substrate of alternating insulating and conducting layers, wherein the conducting layers alternate in thickness between approximately $r_o$ and $0.366r_o$ and the conducting layer of thickness $r_o$ has a circular hole of radius approximately $r_o$ in the center;

two endcap electrodes, one attached at each end of the planar substrate to form an ion trap, wherein the two end cap electrodes and the planar substrate form a trapping chamber;

means for grounding the conducting layers of thickness $0.366r_o$; and means for alternately applying positive and negative rf voltages to the conducting layers of thickness $r_o$, wherein the electrode for the quadrupole mass analyzer produces a substantially quadrupolar rf electric field distribution.

17. The ion trap quadrupole mass analyzer of claim 16, wherein the layers are fabricated on a micro-device scale.

18. An ion trap quadrupole mass analyzer for analyzing samples comprising:

a first pair of parallel, planar conducting rods, each having an axis of symmetry;

a second pair of planar conducting rods each having an axis of symmetry parallel to said first pair of rods and disposed such that a line perpendicular to each of said first axes of symmetry and a line perpendicular to each of said second axes of symmetry bisect each other and form a generally 90 degree angle;

two endcap electrodes, one attached at each end of the two pairs of rods to form an ion trap, wherein the two end cap electrodes and the two pairs of rods form a trapping chamber;

means for applying a positive rf voltage to the first pair of rods; and means for applying a negative rf voltage to the second pair of rods, wherein the two pairs of rods for the ion trap quadrupole mass analyzer produces a substantially pure quadrupolar rf electric field distribution.

19. A method of fabricating a quadrupole mass analyzer for analyzing samples comprising:

(a) obtaining a planar substrate of alternating insulating and conducting layers, which the conducting layers alternate in thickness between first layers with a thickness of $r_o$ and second layers with a thickness of substantially $0.366r_o$;

(b) drilling a circular hole of radius substantially $r_o$ in a center of a conducting layer of thickness $r_o$.

(c) alternately applying rf drive of alternative pluralities to the conducting layers of thickness $r_o$; and (d) grounding the conducting layers of thickness $0.366r_o$.

20. The method of fabricating a quadrupole mass analyzer of claim 19 further comprising:

attaching two endcap electrodes, one attached at each end of the planar substrate to form an ion trap, wherein the two end cap electrodes and the planar substrate form a trapping chamber.

21. A method of fabricating an array of quadrupole mass analyzers for analyzing samples comprising:

(a) laying a planar substrate of alternating insulating and conducting layers, wherein the conducting layers alternate in thickness between approximately $r_o$ and $0.366r_o$;

(b) drilling circular holes of radius approximately $r_o$ in the centers of the conducting layers of thickness $r_o$, wherein the centerline axes of the holes are at least $2.5r_o$ apart;

(c) alternately applying positive and negative rf voltages to the conducting layers of thickness $r_o$; and (d) grounding the conducting layers of thickness $0.366r_o$.

22. The method of fabricating an array of quadrupole mass analyzer of claim 19 further comprising:

attaching two endcap electrodes to each quadrupole mass analyzer, one attached at each end of each analyzer to form an array of ion traps.

* * * * *

UNITED STATES PATENT AND TRADEMARK OFFICE
CERTIFICATE OF CORRECTION

PATENT NO. : 6,157,031

DATED : DECEMBER 5, 2000

INVENTOR(S) : JOHN D. PRESTAGE

It is certified that error appears in the above-identified patent and that said Letters Patent is hereby corrected as shown below:

On the front page [54] please correct the spelling of "Quadropole" to --Quadrupole--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*